US011946193B2

(12) United States Patent
Lee et al.

(10) Patent No.: US 11,946,193 B2
(45) Date of Patent: Apr. 2, 2024

(54) LAUNDRY TREATING APPARATUS

(71) Applicant: LG ELECTRONICS INC., Seoul (KR)

(72) Inventors: Donghwan Lee, Seoul (KR); Myungshik Kim, Seoul (KR); Jeaseok Seong, Seoul (KR); Sungkyong Han, Seoul (KR); Junyi Heo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/991,334

(22) Filed: Nov. 21, 2022

(65) Prior Publication Data

US 2023/0079611 A1 Mar. 16, 2023

Related U.S. Application Data

(63) Continuation of application No. 16/562,379, filed on Sep. 5, 2019, now Pat. No. 11,525,207.

(30) Foreign Application Priority Data

Sep. 6, 2018 (KR) ..... 10-2018-0106544
Sep. 6, 2018 (KR) ..... 10-2018-0106545

(51) Int. Cl.
*D06F 58/10* (2006.01)
*D06F 58/24* (2006.01)
(Continued)

(52) U.S. Cl.
CPC ..... *D06F 58/10* (2013.01); *D06F 58/24* (2013.01); *D06F 58/26* (2013.01); *D06F 58/30* (2020.02);
(Continued)

(58) Field of Classification Search
None
See application file for complete search history.

(56) References Cited

U.S. PATENT DOCUMENTS 3,739,496 A 6/1973 Buckley et al.
4,493,160 A 1/1985 Brembilla et al.
(Continued)

FOREIGN PATENT DOCUMENTS

CN 102131978 A 7/2011
CN 104695195 A 6/2015
(Continued)

OTHER PUBLICATIONS

European Partial Search Report dated Nov. 26, 2019.
(Continued)

*Primary Examiner* — Cristi J Tate-Sims
(74) *Attorney, Agent, or Firm* — Birch, Stewart, Kolasch & Birch, LLP

(57) ABSTRACT

A laundry treating apparatus includes a cabinet; a laundry receiving space defined in the cabinet and configured for receiving laundry therein; an insertion opening defined in a front face of the cabinet and in fluid communication with the laundry receiving space; a door rotatably fixed to the cabinet to open and close the insertion opening; a supply unit configured to supply at least one of air or water vapor to the laundry receiving space; a support assembly provided in the laundry receiving space and configured to support the laundry; and a conveying part configured to move the support assembly toward the insertion opening when the door opens the insertion opening.

15 Claims, 10 Drawing Sheets

(51) Int. Cl.

| | |
|---|---|
| ***D06F 58/26*** | (2006.01) |
| ***D06F 58/30*** | (2020.01) |
| ***D06F 73/02*** | (2006.01) |
| *D06F 103/00* | (2020.01) |
| *D06F 103/34* | (2020.01) |
| *D06F 103/44* | (2020.01) |
| *D06F 105/46* | (2020.01) |

(52) U.S. Cl.
CPC ..... *D06F 73/02* (2013.01); *D06F 2103/00* (2020.02); *D06F 2103/34* (2020.02); *D06F 2103/44* (2020.02); *D06F 2105/46* (2020.02)

(56) References Cited

U.S. PATENT DOCUMENTS

| | | | | |
|---|---|---|---|---|
| 2008/0155757 | A1* | 7/2008 | Kim | D06F 58/203 8/149.3 |
| 2010/0043500 | A1* | 2/2010 | Yoo | D06F 73/02 68/5 C |
| 2011/0005276 | A1 | 1/2011 | Moon et al. | |
| 2013/0047677 | A1 | 2/2013 | Han et al. | |
| 2014/0038086 | A1 | 2/2014 | Shih et al. | |
| 2014/0238086 | A1* | 8/2014 | Choi | D06F 58/20 68/20 |
| 2015/0159315 | A1* | 6/2015 | Lim | D06F 58/10 38/3 |
| 2017/0002504 | A1 | 1/2017 | Jung | |
| 2017/0327306 | A1 | 11/2017 | Nam et al. | |

FOREIGN PATENT DOCUMENTS

| | | | |
|---|---|---|---|
| CN | 105297335 | A | 2/2016 |
| CN | 1063198929 | A | 1/2017 |
| CN | 107385829 | A | 11/2017 |
| CN | 107460702 | A | 12/2017 |
| EP | 3 112 515 | A1 | 1/2017 |
| EP | 3 246 458 | A1 | 11/2017 |
| EP | 3 321 413 | A1 | 5/2018 |
| JP | 2006-149495 | A | 6/2006 |
| JP | 2012-143617 | A | 8/2012 |
| KR | 10-2010-0022799 | A | 3/2010 |
| KR | 10-2011-0067892 | A | 6/2011 |
| KR | 10-2013-0028434 | A | 3/2013 |
| KR | 10-1318359 | B1 | 10/2013 |
| KR | 10-2014-0108454 | A | 9/2014 |
| KR | 10-2016-0099247 | A | 8/2016 |
| KR | 10-2017-0002891 | A | 1/2017 |
| KR | 10-2018-0094822 | A | 8/2018 |
| RU | 2014116894 | A | 11/2015 |
| WO | WO 2009/020313 | A2 | 2/2009 |
| WO | WO 2011/108860 | A2 | 9/2011 |

OTHER PUBLICATIONS

European Search Report dated Feb. 26, 2020.
First Notification of Office Action issued in Application No. 201910836694.5 by The State Intellectual Property Office of China, dated Jun. 17, 2021.
International Search Report dated Jan. 15, 2020.
Official Action issued in Application No. 2021107576 by "Federal Institute of Industrial Property", dated Sep. 2, 2021.

* cited by examiner

LAUNDRY TREATING APPARATUS

CROSS-REFERENCE TO RELATED APPLICATIONS

This application is a Continuation of U.S. application Ser. No. 16/562,379, filed on Sep. 5, 2019, which claims priority to Korean Patent Applications Nos. 10-2018-0106544, filed on Sep. 6, 2018, and 10-2018-0106545, filed on Sep. 6, 2018, in Korea, the entire contents of which are hereby incorporated by reference in their entireties

TECHNICAL FIELD

The present disclosure relates to a laundry treating apparatus.

BACKGROUND

In general, a laundry treating apparatus is an apparatus for performing various treating operations (washing, drying, deodorizing, removing wrinkles, and the like) related to laundry. The laundry treating apparatus is a concept including a washing machine for washing the laundry, a drying machine for drying wet laundry, a refresher for removing odors, wrinkles, and the like of the laundry, and the like.

Conventional laundry treating apparatuses perform the treating operation while rubbing the laundry with a drum using the drum in which the laundry is accommodated, a driving apparatus for rotating the drum, an apparatus for supplying air into the drum, and the like. Therefore, the conventional laundry treating apparatus is advantageous to dry the laundry, but is insufficient to prevent an occurrence of wrinkles in the laundry or to remove the wrinkles in the laundry because the conventional laundry provides a frictional force to the laundry continuously.

Technical Purpose

One purpose of the present disclosure is to provide a laundry treating apparatus that may dry, deodorize, and remove wrinkles of laundry using a support assembly which allows the laundry to be fixed in an unfolded state, and at least one of air or water vapor in a laundry receiving space.

Another purpose of the present disclosure is to provide a laundry treating apparatus that may automatically extend a water discharge tank in which condensate water discharged from an air supply part that supplies air into a laundry receiving space is collected.

Another purpose of the present disclosure is to provide a laundry treating apparatus that may automatically extend a water supply tank for supplying water to a moisture supply part for supplying water vapor into a laundry receiving space.

Another purpose of the present disclosure is to provide a laundry treating apparatus that improves a user convenience using a support assembly that moves laundry or a hanger to which the laundry is fixed toward an insertion opening when a door is opened.

Technical Solution

In a first aspect of the present disclosure, there is provided a laundry treating apparatus including: a cabinet; a laundry receiving space provided in the cabinet to provide a space for receiving laundry therein; a support assembly provided in the laundry receiving space for supporting the laundry; a first chamber in communication with the laundry receiving space through a discharging opening and a supplying opening and positioned below the laundry receiving space; an insertion opening provided in a front face of the cabinet in communication with the laundry receiving space; a communication opening provided in the front face of the cabinet in communication with the first chamber; a duct provided in the first chamber to connect the discharging opening and the supplying opening with each other; a first heat exchanger provided inside the duct to dehumidify air entering the duct; a second heat exchanger provided inside the duct to heat air passing through the first heat exchanger; a chamber door for opening and closing the communication opening; a water discharge tank detachably connected to the chamber door and storing condensate water discharged from the first heat exchanger therein; and a chamber door conveying part for allowing the chamber door to reciprocate between a first point where the chamber door closes the communication opening and a second point where the chamber door opens the communication opening for exposing the water discharge tank out of the first chamber.

In one implementation of the first aspect, the laundry treating apparatus may further include: a moisture supply part provided in the first chamber to supply unheated water vapor or heated water vapor into the laundry receiving space; and a water supply tank detachably connected to the chamber door to supply water to the moisture supply part.

In one implementation of the first aspect, the chamber door may be a drawer extendable and retractable from and into the first chamber.

In one implementation of the first aspect, the chamber door may include: a support body positioned inside the first chamber to support the water discharge tank; and a chamber door body fixed to the support body to close the communication opening but to open the communication opening when the support body is extended from the first chamber, wherein the chamber door conveying part may include: a body rack provided on the support body; a body pinion coupled to the body rack; and a body pinion motor provided in the first chamber to rotate the body pinion.

In one implementation of the first aspect, the laundry treating apparatus may further include: a control command input unit for generating a control command for moving the chamber door from the first point to the second point and a control command for moving the chamber door from the second point to the first point.

In one implementation of the first aspect, the laundry treating apparatus may further include: a guide provided on one of the chamber door body and the support body along a longitudinal direction of the chamber door body; a housing movable along the guide and including therein a housing mounting portion into which the water discharge tank is received; and a housing conveying part for reciprocating the housing along the longitudinal direction of the chamber door body.

In one implementation of the first aspect, the housing conveying part may include: a housing rack provided on the housing along the longitudinal direction of the chamber door body; a housing pinion coupled to the housing rack; and a housing pinion motor fixed to one of the chamber door body and the support body to rotate the housing pinion.

In one implementation of the first aspect, the laundry treating apparatus may further include: a first water discharging pipe for discharging condensate water generated in the first heat exchanger out of the duct; a second water discharging pipe connected to the water discharge tank when the chamber door moves from the second point to the first point and separated from the water discharge tank when the chamber door moves from the first point to the second point; and a pump for transferring water supplied from the first water discharging pipe to the second water discharging pipe.

In one implementation of the first aspect, the laundry treating apparatus may further include: a moisture supply part provided in the first chamber to supply unheated water vapor or heated water vapor into the laundry receiving space; a water supply tank providing a space in which water is stored and detachable from the housing mounting portion; and a water supplying portion provided on the moisture supply part to be connected to the water supply tank when the chamber door moves from the second point to the first point and to be separated from the water supply tank when the chamber door moves from the first point to the second point.

In one implementation of the first aspect, the laundry treating apparatus may further include: a control command input unit for sequentially generating a control command for sequentially executing a forward movement command for moving the chamber door from the first point to the second point and an ascending command for moving the housing to be away from the support body and a control command for sequentially executing a descending command for moving the housing toward the support body and a rearward movement command for moving the chamber door from the second point to the first point.

In one implementation of the first aspect, the laundry treating apparatus may further include: a door pivotably fixed to the cabinet to open and close the insertion opening; a door detection unit for detecting whether the door opened the insertion opening; and a conveying part for moving the support assembly toward the insertion opening when the door opens the insertion opening and for moving the support assembly to be away from the insertion opening when the door closes the insertion opening.

In one implementation of the first aspect, when the door closes the insertion opening, the conveying part may move the support assembly to be away from the insertion opening.

In one implementation of the first aspect, a distance from the insertion opening to a center of the support assembly may be set to be equal to or below ⅓ of a length of the laundry receiving space parallel to a direction of movement of the support assembly when the door opens the insertion opening.

In one implementation of the first aspect, the distance from the insertion opening to the center of the support assembly may be set to be equal to above ½ of the length of the laundry receiving space parallel to the direction of movement of the support assembly when the door closes the insertion opening.

In one implementation of the first aspect, the laundry treating apparatus may further include: a second chamber distinguished from the laundry receiving space via a first partition and positioned above the laundry receiving space; a first slit provided to penetrate the first partition to communicate the laundry receiving space with the second chamber, wherein the first slit is parallel to the direction of movement of the support assembly; and a second slit provided to penetrate the first partition to communicate the laundry receiving space with the second chamber, wherein the second slit is parallel to the first slit. The support assembly may include: a base provided inside the second chamber and capable of reciprocating between the front face and a rear face of the cabinet; a first connector having one end thereof fixed to the base and the other free end thereof inserted into the first slit to be positioned in the laundry receiving space; a second connector having one end thereof fixed to the base and the other free end thereof inserted into the second slit to be positioned in the laundry receiving space; and a support bar having one end thereof fixed to the first connector and the other end thereof fixed to the second connector to support a hanger.

In one implementation of the first aspect, the conveying part may include: a rack provided on the base to be parallel to a direction of movement of the base; a pinion coupled to the rack; and a pinion motor for rotating the pinion.

In one implementation of the first aspect, the laundry treating apparatus may further include: an actuating assembly for reciprocating the support bar along a width direction of the laundry receiving space.

In one implementation of the first aspect, the laundry treating apparatus may further include: a lamp provided on the support bar to emit light when the door opens the insertion opening.

In one implementation of the first aspect, the door may include: a door body pivotably fixed to the cabinet to open and close the insertion opening; an accommodating space defined in a door front face exposed to an outside when the door body closes the insertion opening among spaces provided by the door body; an accommodating space door pivotably fixed to the door body to open and close the accommodating space; a laundry fixing portion provided in the accommodating space to fix one end of pants; a presser support body to support one face of the pants fixed to the laundry fixing portion; and a compression body provided on the accommodating space door to press the pants towards the presser support body when the accommodating space door closes the accommodating space.

In one implementation of the first aspect, the laundry treating apparatus may further include: a supply hole provided to penetrate the presser support body to communicate the laundry receiving space with the accommodating space.

In a second aspect of the present disclosure, there is provided another laundry treating apparatus including: a cabinet; a laundry receiving space provided in the cabinet to provide a space for receiving laundry therein; an insertion opening provided in a front face of the cabinet in communication with the laundry receiving space; a door pivotably fixed to the cabinet to open and close the insertion opening; a supply for supplying at least one of air or water vapor to the laundry receiving space; a support assembly provided in the laundry receiving space for supporting the laundry; a door detection unit for detecting whether the door opened the insertion opening; and a conveying part for moving the support assembly toward the insertion opening when the door opens the insertion opening.

In one implementation of the second aspect, the door detection unit may be provided to move the support assembly to be away from the insertion opening when the door closes the insertion opening.

In one implementation of the second aspect, a distance from the insertion opening to a center of the support assembly may be set to be equal to or below ⅓ of a length of the laundry receiving space parallel to a direction of movement of the support assembly when the door opens the insertion opening.

In one implementation of the second aspect, the distance from the insertion opening to the center of the support assembly may be set to be equal to above ½ of the length of the laundry receiving space parallel to the direction of movement of the support assembly when the door closes the insertion opening.

In one implementation of the second aspect, the present disclosure may include: a second chamber (or an upper chamber) distinguished from the laundry receiving space via a first partition and positioned above the laundry receiving space; a first slit provided to penetrate the first partition to communicate the laundry receiving space with the second chamber (the upper chamber), wherein the first slit is parallel to the direction of movement of the support assembly; and a second slit provided to penetrate the first partition to communicate the laundry receiving space with the second chamber (the upper chamber), wherein the second slit is parallel to the first slit. The support assembly may include: a base provided inside the second chamber (the upper chamber) and capable of reciprocating between the front face and a rear face of the cabinet; a first connector having one end thereof fixed to the base and the other free end thereof inserted into the first slit to be positioned in the laundry receiving space; a second connector having one end thereof fixed to the base and the other free end thereof inserted into the second slit to be positioned in the laundry receiving space; and a support bar having one end thereof fixed to the first connector and the other end thereof fixed to the second connector to support a hanger.

In one implementation of the second aspect, the conveying part may include: a rack provided on the base to be parallel to a direction of movement of the base; a pinion coupled to the rack; and a pinion motor for rotating the pinion.

In one implementation of the second aspect, the present disclosure may further include: an actuating assembly for reciprocating the support bar along a width direction of the laundry receiving space.

In one implementation of the second aspect, the present disclosure may further include: a lamp provided on the support bar to emit light when the door opens the insertion opening.

In one implementation of the second aspect, the door may include: a door body pivotably fixed to the cabinet to open and close the insertion opening; an accommodating space defined in a door front face exposed to an outside when the door body closes the insertion opening among spaces provided by the door body; an accommodating space door pivotably fixed to the door body to open and close the accommodating space; a laundry fixing portion provided in the accommodating space to fix one end of pants; a presser support body to support one face of the pants fixed to the laundry fixing portion; and a compression body provided on the accommodating space door to press the pants towards the presser support body when the accommodating space door closes the accommodating space.

In one implementation of the second aspect, the present disclosure may further include: a supply hole provided to penetrate the presser support body to communicate the laundry receiving space with the accommodating space.

In one implementation of the second aspect, the supply may include: an air supply part for supplying heated air to the laundry receiving space; and a moisture supply part for supplying unheated water vapor or heated water vapor to the laundry receiving space.

Technical Effect

In one implementation of the second aspect, the laundry treating apparatus that may dry, deodorize, and remove the wrinkles of the laundry using the support assembly which allows the laundry to be fixed in the unfolded state, and at least one of the air or water vapor in the laundry receiving space is provided.

Further, according to the present disclosure, the laundry treating apparatus that may automatically extend the water discharge tank in which the condensate water discharged from the air supply part that supplies the air into the laundry receiving space is collected is provided.

Further, according to the present disclosure, the laundry treating apparatus that may automatically extend the water supply tank for supplying the water to the moisture supply part for supplying the water vapor into the laundry receiving space is provided.

Further, according to the present disclosure, the laundry treating apparatus that improves the user convenience using the support assembly that moves the laundry or the hanger to which the laundry is fixed toward the insertion opening when the door is opened is provided.

DETAILED DESCRIPTION

Hereinafter, the present disclosure will be described using drawings and embodiments that specifically specify components and the like of the present disclosure. Those are used to help understand the present disclosure. Those may be shown or described as being exaggerated or reduced for a convenience of the technology and understanding.

Figure 1:
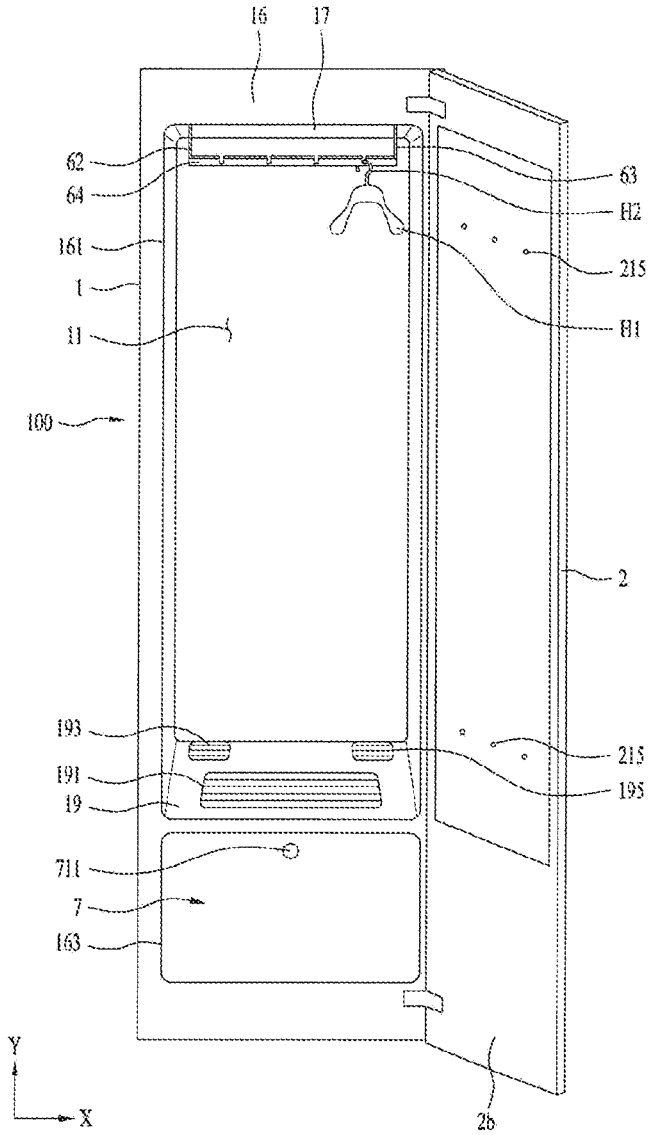
FIGS. 1 and 2 illustrate an example of a laundry treating apparatus of the present disclosure.

As shown in FIG. 1, a laundry treating apparatus 100 of the present disclosure include a cabinet 1 having therein a laundry receiving space 11 for providing a space to keep laundry in a unfolded state, supply parts 3 and 4 for supplying at least one of air or water vapor to the laundry receiving space 11, a laundry support 6 provided in the laundry receiving space to support the laundry or a hanger H1 to which the laundry is fixed, and a door 2 for opening and closing the laundry receiving space 11.

Figure 2:
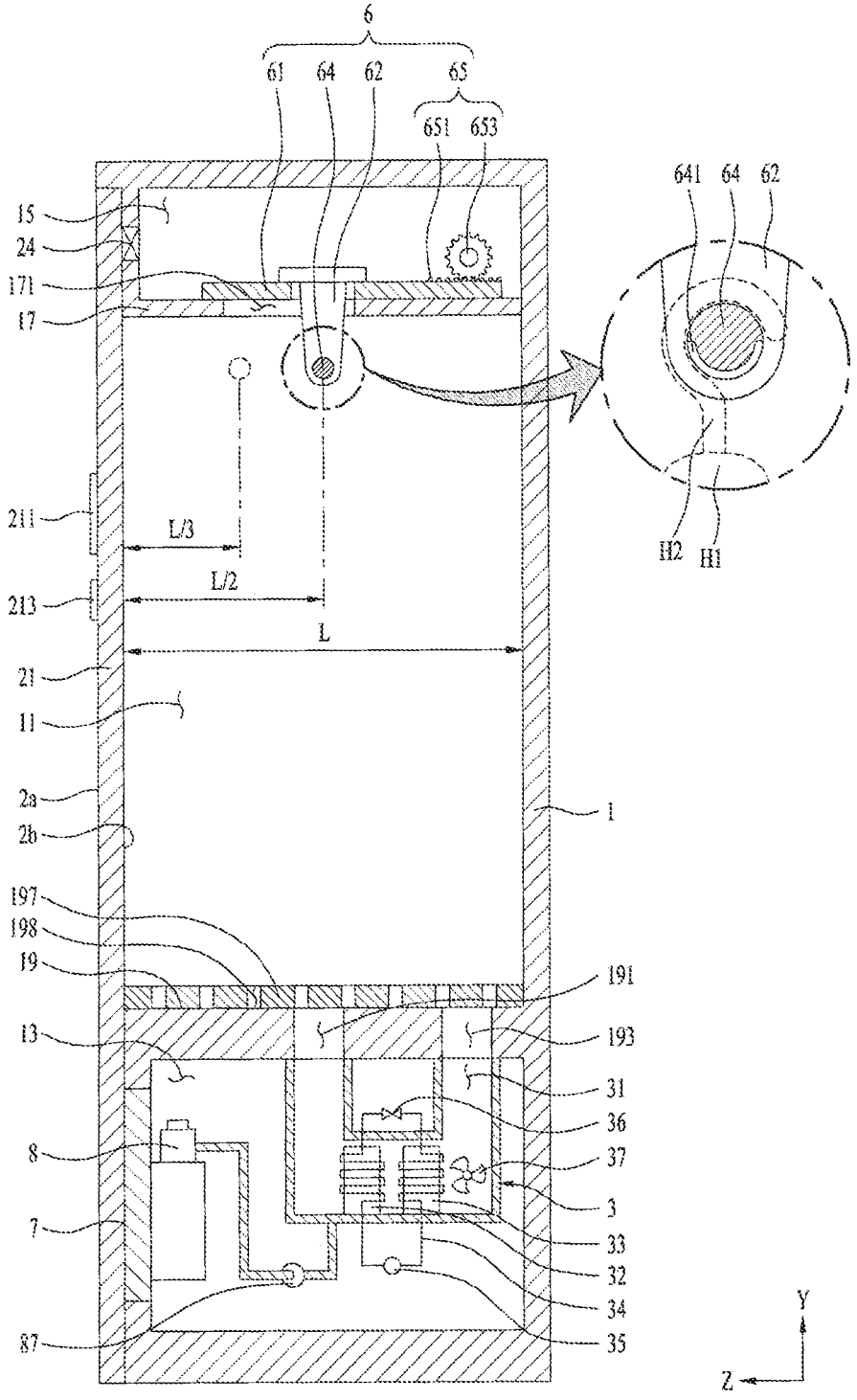

As shown in FIG. 2, the cabinet 1 may include a second chamber 15 (an upper chamber) located above the laundry receiving space 11 and a first chamber 13 (a lower chamber) located below the laundry receiving space 11. The second chamber 15 is a space in which the laundry support 6 is installed and the first chamber 13 is a space in which the supply parts 3 and 4 are installed.

The second chamber 15 is distinguished from the laundry receiving space 11 via a first partition 17 (upper partition) and the first chamber 13 is distinguished from the laundry receiving space 11 via a second partition 19 (lower partition). Thus, a lower face of the first partition 17 forms an upper face of the laundry receiving space 11 and an upper face of the second partition 19 forms a bottom face of the laundry receiving space 11.

As shown in FIG. 1, the cabinet 1 has an insertion opening 161 which penetrates a front face 16 and is in communication with the laundry receiving space 11 and a communication opening 163 which penetrates the front face 16 and is in communication with the second chamber 15. The insertion opening 161 may be opened and closed by the door 2 and the communication opening 163 may be opened and closed by a chamber door 7 to be described below.

As shown in FIG. 2, the door 2 may be provided as a door body 21 pivotably fixed to the cabinet 1 to open and close the insertion opening 161. The door body 21 may be provided to cover the entirety of the cabinet front face 16 or may be provided to cover a portion of the cabinet front face 16. In a former case, a front face of the laundry treating apparatus 100 will be formed by the door body 21 and in the latter case, the front face of the laundry treating apparatus will be formed by some regions of the cabinet front face 16 (regions exposed on a front side of the laundry treating apparatus) and the door body 21.

The door body 21 may be formed in a board with a door front face 2*a* forming a front face of the laundry treating apparatus and a door rear face 2*b* facing the cabinet front face 16.

The door front face 2*a* may include an input unit 213 for receiving a control command from a user and a display unit 211 for displaying control commands selectable to the user, an execution process of a selected control command, or the like.

The supplies provided in the first chamber 13 may include an air supply part 3 for supplying heated or unheated air to the laundry receiving space 11 and a moisture supply part 4 (see FIG. 8) for supplying heated water vapor (steam) or unheated water vapor to the laundry receiving space.

The air supply part 3 may include a duct 31 provided in the first chamber 13, a heat exchanging assembly 32, 33, 34, 35, and 36, and a fan 37 provided in the duct. The duct 31 is a flow path which discharges air inside the laundry receiving space 11 to the heat exchanging assembly 32, 33, 34, 35, and 36 and supplies air passed through the heat exchanging assembly to the laundry receiving space 11.

The second partition 19 may include therein a discharging opening 191 and a supplying opening 193 provided to communicate the laundry receiving space 11 and the first chamber 13 with each other. The duct 31 may be provided in the first chamber 13 to connect the discharging opening 191 and the supplying opening 193. Thus, when the fan 37 inside the duct 31 rotates, air in the laundry receiving space 11 will enter the duct 31 through the discharging opening 191 and then move to laundry receiving space 11 through the supplying opening 193.

The laundry treating apparatus 100 of the present disclosure may further include a cover for preventing foreign substances from entering the discharging opening 191 and the supplying opening 193. The cover may include a cover body 197 seated on the upper face of the second partition 19 and a plurality of cover through-holes 198 provided to penetrate the cover body.

The heat exchanging assembly may be provided in any form as long as the heat exchanging assembly may dehumidify (remove water vapor contained in air) air entered the duct 31 via the discharging opening 191 and heat the dehumidified air. FIG. 2 illustrates an example in which the heat exchanging assembly is provided as a heat pump.

In this case, the heat exchanging assembly 32, 33, 34, 35, and 36 includes a refrigerant pipe 34 for providing a circulating flow path of a refrigerant, a first heat exchanger 32 (heat absorber), which is fixed to the refrigerant pipe 34 and is located between the discharging opening 191 and the fan 37, a second heat exchanger 33 (heat emitter), which is fixed to the refrigerant pipe 34 and is located between the first heat exchanger 32 and the fan 37, a compressor 35 for allowing the refrigerant to circulate along the refrigerant pipe 34, and an expander 36 for lowering a pressure of the refrigerant which passed through the second heat exchanger 33.

The first heat exchanger 32 and the second heat exchanger 33 may be provided inside the duct 31 and the compressor 35 and expander 36 may be provided outside the duct 31. The first heat exchanger 32 is means for absorbing a heat from the air entered the duct 31 and transferring the heat to the refrigerant circulating inside the refrigerant pipe 34. The refrigerant evaporates while passing through the first heat exchanger 32 and the moisture contained in the air condenses while passing through the first heat exchanger 32.

The second heat exchanger 33 is means for transferring the heat of the refrigerant discharged from the compressor 35 to the air passed through the first heat exchanger 32. The refrigerant condenses while passing through the second heat exchanger 33 and the air is heated while passing through the second heat exchanger 33.

As shown in FIG. 1, the laundry support 6 may have a support bar 64 to which a hook H2 of the hanger is supported and a first connector 62 and a second connector 63 for connecting both ends of the support bar to the first partition 17. When the support bar 64 is located near a center of an upper face of the laundry receiving space 11, it may be inconvenient for a user who is short to hang the hook H2 of the hanger to the support bar 64 or to separate the hook H2 from the support bar 64.

To this end, the laundry support 6 provided in the present disclosure may be provided to be movable along a depth direction (Z-axis direction) of the laundry receiving space. That is, as shown in FIG. 2, the laundry support 6 may include a support assembly 61, 62, 63, and 64 to which the hanger H1 is detachably connected and a conveying part allowing the support assembly to move along the depth direction (Z-axis direction) of the laundry receiving space 65.

The support assembly may include a base 61 (a base that may reciprocate along the Z-axis) that may reciprocate between the front face 16 and rear face of the cabinet inside the second chamber 15, a first connector 62 and a second connector 63, each of which having one end thereof fixed to the base and the other free end thereof positioned in the laundry receiving space 11, and the support bar 64 having one end thereof fixed to the first connector 62 and the other end thereof fixed to the second connector 63 to support the hook H2 of the hanger.

The first partition 17 includes therein a first slit 171 and a second slit (not shown) that communicate the second chamber 15 with laundry receiving space 11. Further, the first connector 62 should be inserted into the first slit 171 and the second connector 63 should be inserted into the second slit.

The first slit 171 extends from a rear portion of the laundry receiving space to a front portion of the laundry receiving space where the insertion opening 161 is positioned (extends along the Z-axis). Further, the second slit is provided parallel to the first slit 171.

The conveying part 65 may be provided in various forms as long as the conveying part 65 may reciprocate the base 61 in a direction between a portion where a center of the laundry receiving space 11 positioned and a portion where the insertion opening 161 is positioned. FIG. 2 illustrates an example in which the conveying part 65 includes a rack 651 provided on the base 61, a pinion 653 provided in the second chamber 15 to be coupled to the rack, and a pinion motor for rotating the pinion.

The conveying part 65 may be provided to move the support bar 64 when the user inputs the control command via an input unit (support assembly control command input unit). The support assembly control command input unit may be provided to sequentially generate a control command for moving the support bar 64 toward the insertion opening 161 and a control command for moving the support bar 64 to be away from the inserting opening 161. The support assembly control command input unit may be provided in the input unit 213 provided on the door front face or may be provided on the door rear face 2*b* or in the laundry receiving space 11.

When the user presses the support assembly control command input unit while the insertion opening 161 is open, the support bar 64 will move toward the insertion opening 161. Therefore, the user may easily hang the hanger hook H2 on the support bar 64. When the user presses the support assembly control command input unit after fixing the hanger H1 to the support bar 64, the support bar 64 will move to be away from the insertion opening. Therefore, the hanger H1 will be prevented from interfering with the door body 21.

In one example, the conveying part 65 may be provided to move the support bar 64 when the door body 21 opens the insertion opening 161. That is, the conveying part 65 may be configured to move the support bar 64 toward the insertion opening 161 (+Z-axis direction) when the door body 21 opens the insertion opening 161 and move the support bar 64 to be away from the insertion opening (−Z-axis direction) when the door body 21 closes the insertion opening 161.

A distance from the insertion opening 161 to a center of the support bar 64 may be set to be equal to or below ⅓ of a length L of the laundry receiving space in the direction of movement of the support bar (a Z-axis length of the laundry receiving space) when the door body 21 opens the insertion opening 161. This is to make it easier to hang the hanger H1 on the support bar 64 or to remove the hanger H1 from the support bar 64.

In one example, the distance from the insertion opening 161 to the center of the support bar 64 may be set to be equal to above ½ of the length L of the laundry receiving space parallel to the direction of the movement of the support bar when the door body 21 closes the insertion opening 161. When the support bar 64 is provided to be positioned at a center point L/2 of the laundry receiving space 11 when the door body closes the insertion opening, a size of the hanger H1 having a shape symmetric around the hanger hook H2 may be maximized (a width of the laundry that may be received in the laundry receiving space may be maximized).

Whether the door body 21 has opened the insertion opening 161 may be identified by a door detection unit 24. FIG. 2 illustrates an example in which the door detection unit 24 is provided on the front face 16 of the cabinet.

The door detecting unit 24 may be provided as a sensor which is in contact with the door body 21 when the door body 21 closes the insertion opening 161 and is separated from the door body 21 when the door body 21 opens the insertion opening 161.

Unlike as shown in FIG. 2, the door detection unit 24 may be provided to detect a pivot direction of the door body. When the door body 21 pivots in a direction of opening the insertion opening 161, the conveying part 65 will move the support bar 64 toward the insertion opening and when the door body 21 pivots in a direction of closing the insertion opening 161, the conveying part 65 will move the support bar 64 to be away from the insertion opening 161.

The support bar 64 may further include a lamp 641 that emits light into the laundry receiving space 11. The lamp 641 may be fixed to a region below a horizontal line passing through the center of the support bar 64. The lamp 641 may be provided to emit the light when the door body 21 opens the insertion opening 161 and to stop the light emission when the door body 21 closes the insertion opening 161.

The laundry support 6 may further include an actuating assembly 67 (see FIG. 3) that reciprocates the support bar 64 along a direction perpendicular to the direction in which the base reciprocates (the Z-axis direction) (X-axis, width direction of the laundry receiving space, and width direction of the insertion opening).

Figure 3:
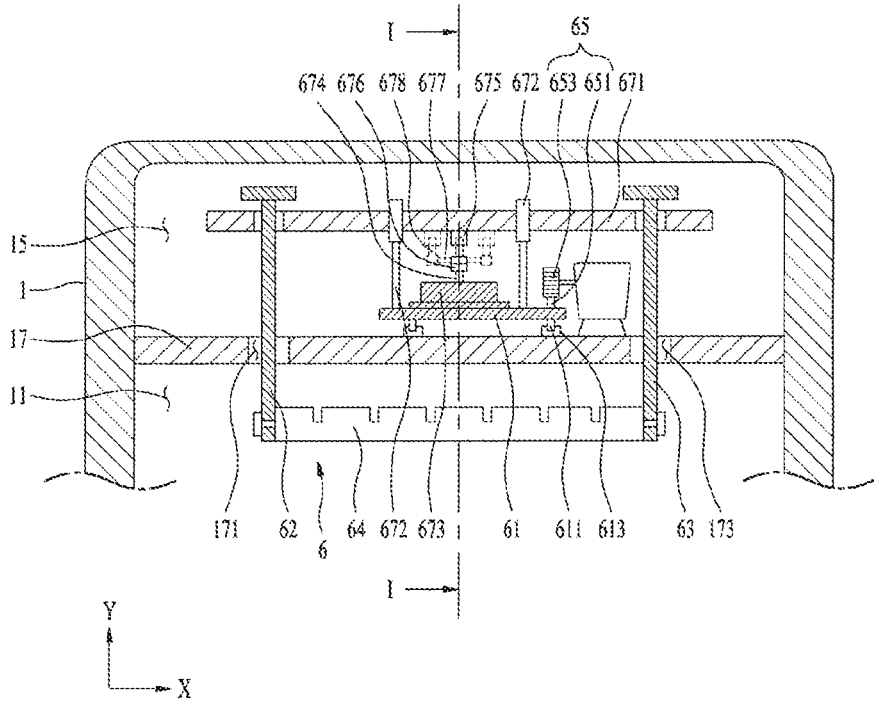
FIGS. 3 to 5 illustrate an example of a laundry support included in the present disclosure.

As shown in FIG. 3, the actuating assembly 67 may include an actuating body 671 supported by an actuating body guide 672 fixed to the base 61, a motor 673 fixed to the base 61, and a converting assembly 671 675, 676, 677, and 678 for converting a rotational force of the motor into a linear motion of the actuating body 671.

The actuating body 671 may be supported by the actuating body guide 672 to reciprocate along the width direction of the laundry receiving space 11 (the X-axis direction). In this case, the first connector 62 and the second connector 63 may be fixed to both ends of the actuating body 671, respectively.

Figure 4:
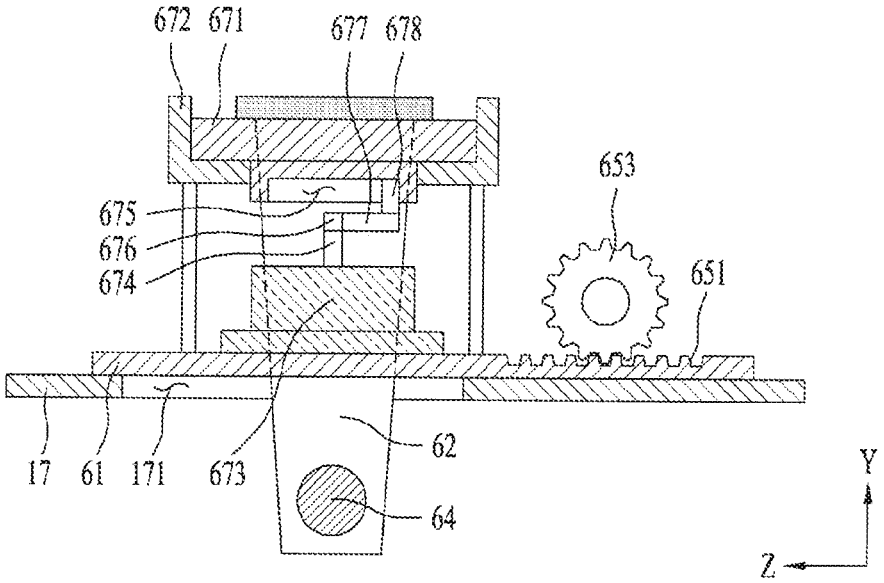

As shown in FIG. 4, the converting assembly may include a slot 675 provided in the operating body 671, a shaft coupling portion 676 fixed to a rotation shaft 674 of the motor, an arm 677 protruding from the shaft coupling portion in a direction orthogonal to the rotation shaft 674, and a slot-inserted portion 678 provided on a free end of the arm and inserted into the slot 675.

Figure 5:
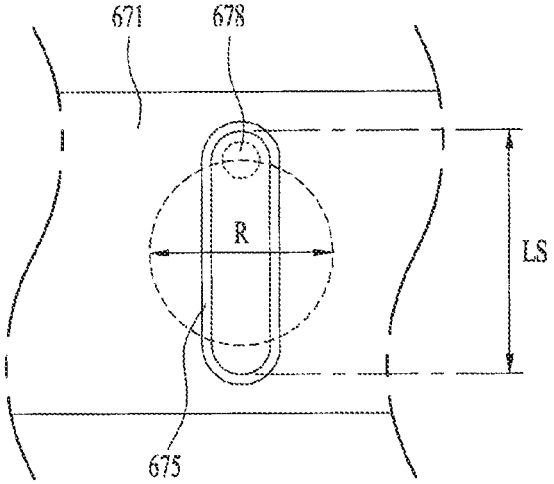

The slot 675 should be provided along a direction orthogonal to a longitudinal direction of the actuating body 671 (the Z-axis direction) and a diameter R of a rotational trajectory formed by the slot-inserted portion should be set to be equal to or below a length LS of the slot (see FIG. 5) such that the actuating body 671 may reciprocate along the width direction of the laundry receiving space (the X-axis direction).

The laundry support 6 may further include a rail 611 that provides a moving path of the base 61 and a rail receiving 613. FIG. 3 illustrates an example in which the rail receiving groove 613 is fixed on the upper face of the first partition 17 and the rail 611 is provided on a lower face of the base 61 to be coupled to the rail receiving groove 613.

When the air supply part 3 is operated to supply air into the laundry receiving space 11, the laundry treating apparatus of the present disclosure may dry the laundry. When the support bar 64 is reciprocated along the width direction of the laundry receiving space by the actuating assembly 67 while the air is supplied into the laundry receiving space, an effect of shortening heat exchange time between the laundry and the air (an effect of shortening drying time) may be expected to be achieved.

In one example, when the moisture supply part 4 is operated to supply water vapor into laundry receiving space 11, the laundry treating apparatus of the present disclosure may remove wrinkles from the laundry. When the support bar 64 is reciprocated along the width direction of the laundry receiving space 11 while the water vapor is supplied into the laundry receiving space, the wrinkles of the laundry may be more effectively removed.

Furthermore, when the water vapor and the air are simultaneously or sequentially supplied into the laundry receiving space, the present disclosure may deodorize the laundry. When the support bar 64 is reciprocated along the width direction of the laundry receiving space while the water vapor and the air are supplied into the laundry receiving space, time required for the deodorization may be minimized.

Figure 6:
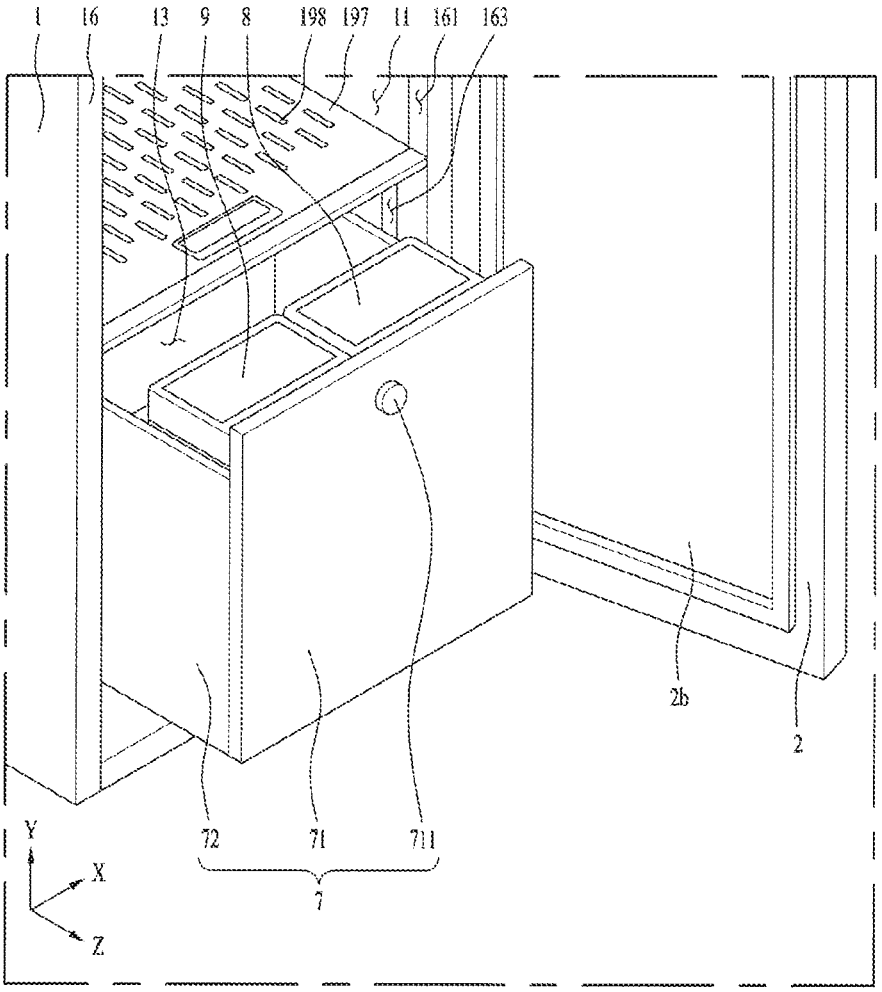
FIG. 6 illustrates an example of a chamber door included in the present disclosure.

As shown in FIG. 6, the laundry treating apparatus 100 of the present disclosure may further include a water discharge tank 8 in which condensate water discharged from the first heat exchanging assembly 32 is stored and a water supply tank 9 for supplying water to the moisture supply part 4.

The water discharge tank 8 and the water supply tank 9 may be provided on the front face 16 of the cabinet to be detachably connected to the chamber door 7 that opens and closes the communication opening 163 which communicates the first chamber 13 with the outside.

The chamber door 7 may be provided in a drawer form that may be extended and retracted from and into the first chamber 13 (FIG. 6) and may be pivotably coupled to the cabinet via a door pivot shaft (not shown) provided on a lower face thereof parallel to a lower face of the cabinet or a side face thereof parallel to a longitudinal direction of the cabinet.

That is, as shown in FIG. 6, the chamber door 7 may include a support body 72 positioned inside the first chamber to support the water discharge tank 8 and the water supply tank 9 and a chamber door body 71 fixed to the support body 72 to open and close the communication opening 163. In this case, the chamber door body 71 opens the communication opening 163 when the support body 72 is extended from the first chamber 13 and closes the communication opening 163 when the support body 72 is inserted into the first chamber 13.

Unlike as shown in the drawing, the chamber door 7 may include a chamber door body that opens and closes the communication opening and a door pivot shaft that connects a lower face or side face of the chamber door body to the cabinet.

Figure 7:
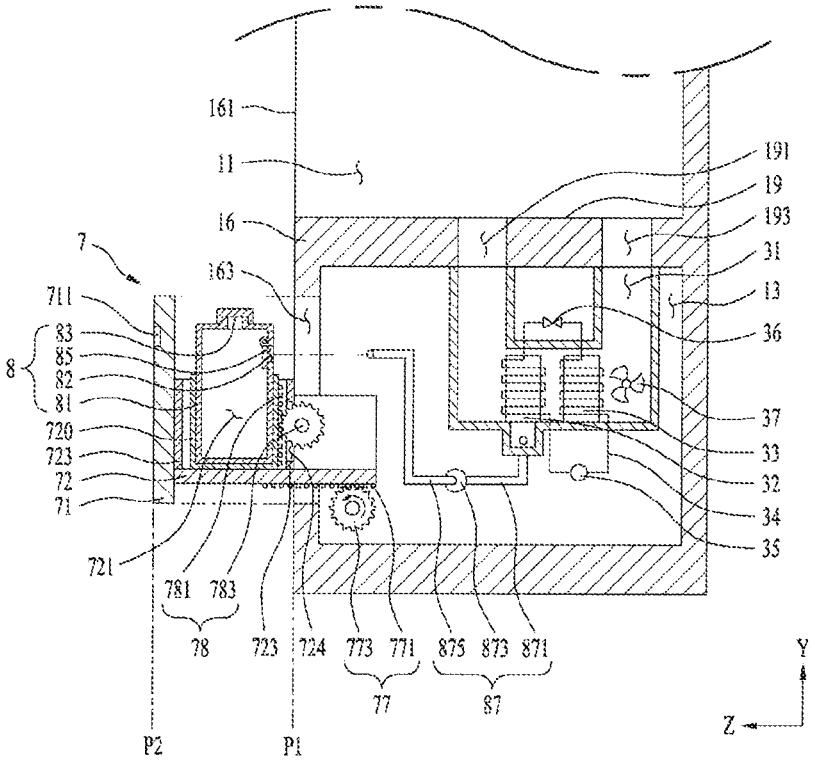
FIGS. 7 to 9 illustrate a structure and operation processes of a chamber door.

As shown in FIG. 7, the chamber door 7 may reciprocate between a first point P1 and a second point P2. The first point P1 is a point at which the chamber door body 71 closes the communication opening 163 and the second point P2 is a point at which the chamber door 7 moves in the direction to open the communication opening so that the water discharge tank 8 and the water supply tank 9 are exposed to the outside of the first chamber 13.

The laundry treating apparatus 100 of the present disclosure may further include a chamber door conveying part 77 that allows the chamber door 7 to reciprocate between the first point P1 and the second point P2 in response to a control signal of a controller (not shown).

The chamber door conveying part 77 may include a body rack 771 provided on the support body 72, a body pinion 773 mounted in the first chamber 13 to be coupled to the body rack, and a body pinion motor (not shown) provided in the first chamber 13 to rotate the body pinion 773.

The chamber door conveying part 77 may be provided to move the chamber door 7 from the first point P1 to the second point P2 in response to a user's request and move the chamber door 71 from the second point P2 to the first point P1 in response to a user's request. To this end, the chamber door body 71 may further include a control command input unit 711. The control command input unit 711 is means for generating a control command (extension command) for moving the chamber door 7 from the first point P1 to the second point P2 and a control command (insertion command) for moving the chamber door 7 from the second point P2 to the first point P1.

The control command input unit 711 may be provided to sequentially generate the extension command and the insertion command. In this case, when the user presses the control command input unit 711 once, the chamber door 7 will move to the second point P2, and when the user presses the control command input unit 711 once more, the chamber door 7 will move to the first point P1.

The water discharge tank 8 and the water supply tank 9 are detachably inserted into a housing 720 including a housing mounting portion 721 therein. The housing 720 may be provided to be movable along a guide 723 provided on one of the chamber door body 71 and the support body 72. That is, the housing 720 may include therein the housing mounting portion 721 into which the water discharge tank 8 is detachably inserted. FIG. 7 illustrates an example in which the guide 723 is provided on the support body 72 along a longitudinal direction of the chamber door body 71.

Furthermore, the housing 720 may reciprocate along the longitudinal direction of the chamber door body 71 via the housing conveying part 78. The housing conveying part 78 may include a housing rack 781 provided on the housing 720 along the longitudinal direction of the chamber door body 71, a housing pinion 783 coupled to the housing rack, and a housing pinion motor (not shown) for rotating the housing pinion 783. The housing pinion motor is fixed to one of the chamber door body 71 and the support body 72.

In this case, the guide 723 should be further provided with a guide through-hole 724. This is to maintain a state in which the housing pinion 783 positioned outside of the guide 723 and the housing rack 781 positioned inside the guide 723 are coupled with each other.

Figure 8:
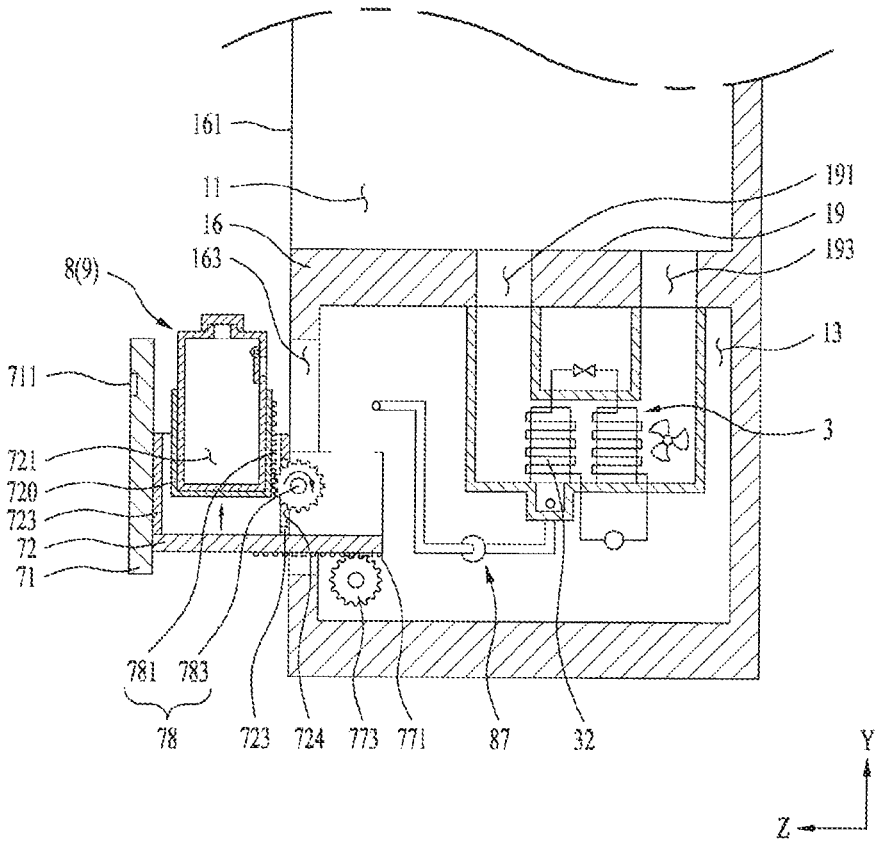

When the housing conveying part 78 is provided, the extension command generated by the control command input unit 711 should be composed by a forward movement command for moving the chamber door 7 from the first point P1 to the second point P2 (see FIG. 7) and an ascending command for moving the housing 720 to be away from the support body 72 (see FIG. 8). In this case, the forward movement command and the ascending command are set to be executed sequentially.

In one example, the insertion command generated by the control command input unit 711 should be set to sequentially execute a descending command for moving the housing 720 toward the support body 72 and a rearward movement command for moving the chamber door 7 from the second point P2 to the first point P1.

As shown in FIG. 7, the water discharge tank 8 may include a water discharge tank body 81, which provides a space for storing water therein and is detachable from the housing mounting portion 721 of the housing 720 and a water discharge tank lid 83 for opening and closing the water discharge tank body.

The condensate water generated in the first heat exchanging assembly 32 is supplied to the water discharge tank body 81 through a water discharging portion 87 provided inside the first chamber. The water discharging portion 87 includes a first water discharging pipe 871 for discharging the condensate water generated in the first heat exchanging assembly 32 to the outside of the duct 31, a second water discharging pipe 875 detachably connected to the water discharge tank body 81, and a pump 873 for transferring the condensate water supplied from the first water discharging portion 871 to the second water discharging portion 875.

The water discharge tank body 81 includes therein a water discharging pipe insertion opening 82 through which the second water discharging pipe 875 is inserted. The water discharging pipe insertion opening 82 may include a water discharge tank valve 85. The water discharge tank valve 85 is means for preventing the condensate water in the water discharge tank body from being discharged out of the water discharge tank body through the water discharging pipe insertion opening 82. The water discharge tank valve 85 may be provided as a check valve.

Thus, when the chamber door 7 moves from the second point P2 to the first point P1, the second water discharging pipe 875 will be inserted into the water discharging pipe insertion opening. Further, when the chamber door 7 moves from the first point P1 to the second point P2, the second water discharging pipe 875 will be separated from the water discharge tank body 81.

Figure 9:
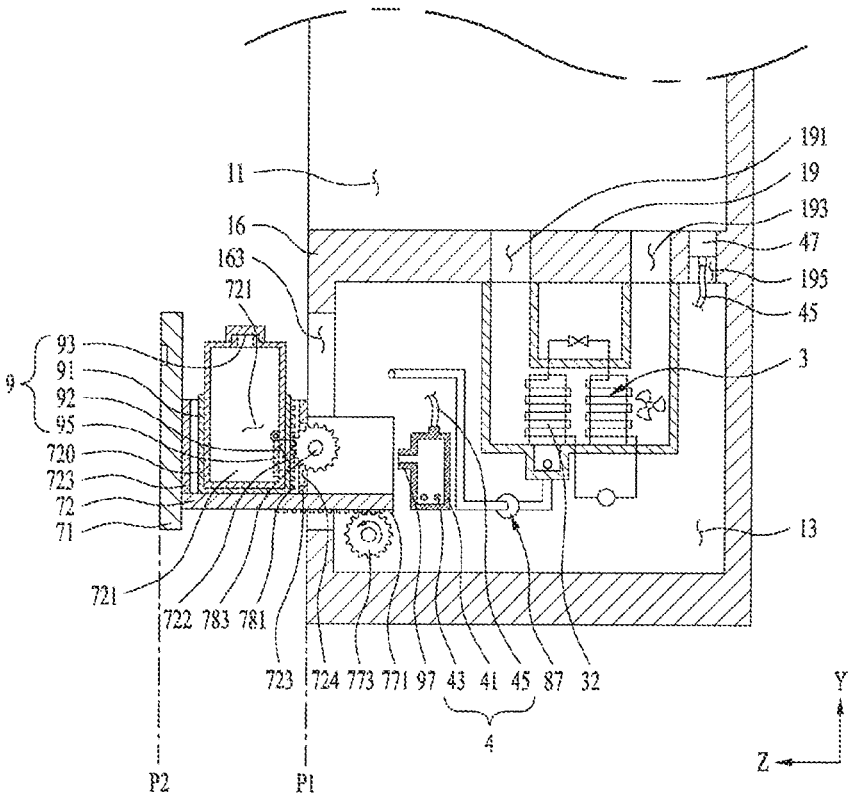

As shown in FIG. 9, the water supply tank 9 is means for supplying water to the moisture supply part 4 provided in the first chamber 13.

The moisture supply part 4 may include water storage 41 provided in the first chamber 13 to provide therein space for storing water, a heater 43 for heating the water inside the water storage to generate steam, and a nozzle 47 for supplying the steam inside the water storage to the laundry receiving space 11.

The second partition 19 includes therein a moisture supplying opening 195 which communicates the laundry receiving space 11 and the first chamber 13 with each other, wherein the nozzle 47 may be fixed to the moisture supplying opening 195. The nozzle 47 and the water storage 41 may be connected to each other via a supply pipe 45.

The housing 720 may include therein the housing mounting portion 721 into which the water supply tank 9 is detachably inserted. Further, the water supply tank 9 includes a water supply tank body 91, which provides a space for storing water therein and is detachable from the housing mounting portion 721 and a water supply tank lid 83 for opening and closing the water supply tank body.

The water stored in the water supply tank body 91 is supplied to the water storage 41 through a water supplying portion 97 provided inside the first chamber. The water supplying portion 97 may be provided as a water supplying pipe protruding from the water storage 41 toward the communication opening 163. In this case, the water supply tank 9 may include a water supplying pipe insertion opening 92 provided to penetrate the water supply tank body 91 and into which the water supplying pipe is inserted and a water supply tank valve 95 for opening and closing the water supplying pipe insertion opening. The housing 720 may further include a housing through-hole 722 through which the water supplying pipe passes. The housing through-hole 722 may be provided to guide the water supplying pipe inserted into the guide through-hole 724 to the water supplying pipe insertion opening 92.

The water supply tank valve 85 is means for preventing the water in the water supply tank body from being discharged out of the water supply tank body through the water supplying pipe insertion opening 92. The water supply tank valve 95 may be provided as a check valve. Thus, when the chamber door 7 moves from the second point P2 to the first point P1, the water supplying pipe will be inserted into the water supplying pipe insertion opening 92. Further, when the chamber door 7 moves from the first point P1 to the second point P2, the water supplying pipe will be separated from the water supplying pipe insertion opening 92.

Figure 10:
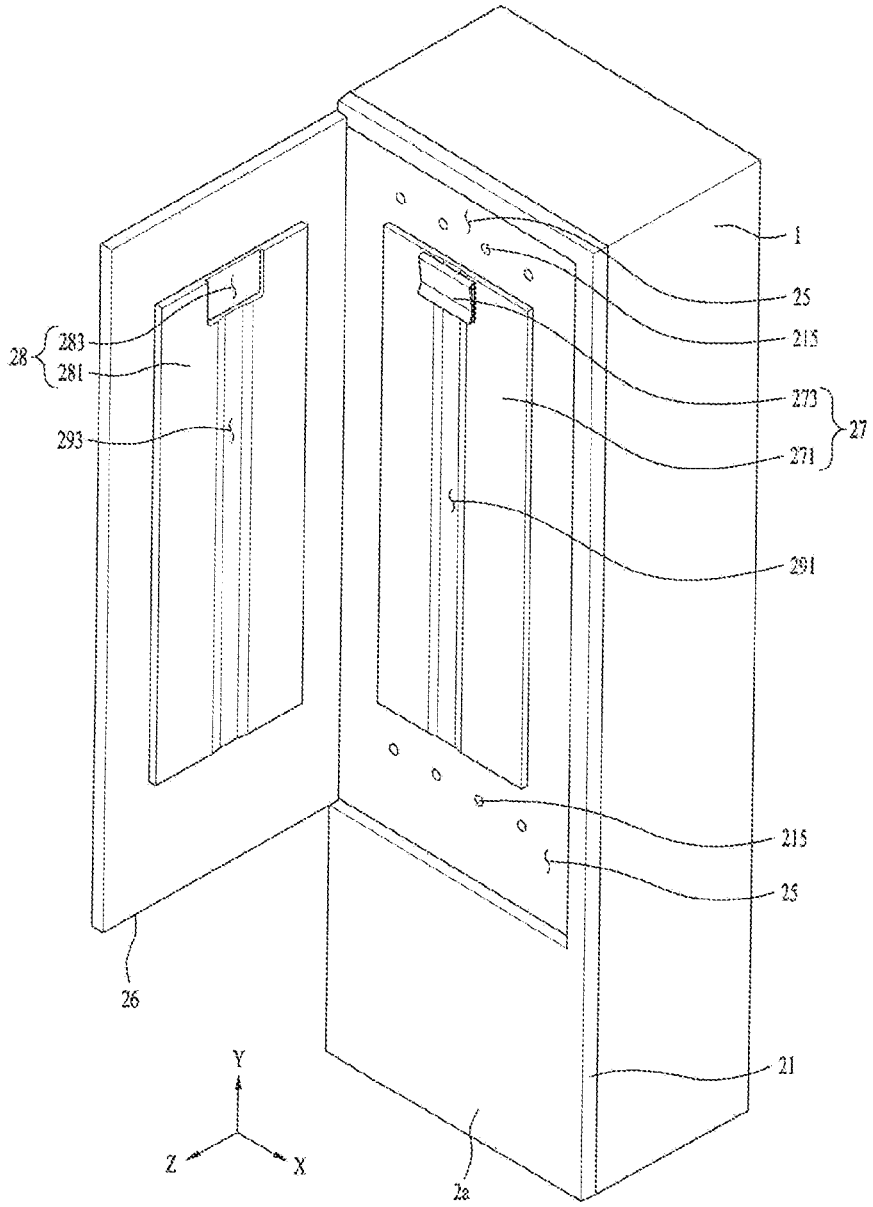
FIG. 10 illustrates an example of a presser included in the present disclosure.

As shown in FIG. 10, the laundry treating apparatus 100 of the present disclosure may further include a presser provided on the door body 21 to reinforce creases included in a design of pants and to unfold wrinkles (folds not included in the design) appeared on the pants.

The presser is preferably provided on the door front face 2*a* among the spaces provided by the door body 21. An area of the laundry receiving space 11 may be maximized and the pants may be fixed to the presser without rotating the door body 21 to open the insertion opening compared to a case in which the presser is provided in the laundry receiving space 11.

The door body 21 includes an accommodating space 25 defined in the door front face 2*a* to provide a space for accommodating the pants therein, an accommodating space door 26 pivotably provided on the door body 21 to open and close the accommodating space, a presser support assembly 27 provided in the accommodating space 25 to support the pants, and a compression portion provided on the accommodating space door 26 to press the pants towards the presser support assembly 27 when the accommodating space door closes the accommodating space 28.

The presser support assembly 27 includes a laundry fixing portion 273 provided in the accommodating space 25 to fix one end of the pants and a presser support body 271 for supporting one face of the pants fixed to the laundry fixing portion. The compression portion 28 may include a compression body 281, which is fixed to the accommodating space door 26 and presses the pants towards the presser support body 271 when the accommodating space door 26 closes the accommodating space 25.

The compression body 281 may further include a fixing portion accommodating groove 283 which provides a space in which the laundry fixing portion 273 is accommodated when the accommodating space door 26 closes the accommodating space 25. In one example, when removing the wrinkles of the pants using the presser, new wrinkles may occur due to a sewing line formed on the pants. To solve this problem, the presser may be further include avoiding grooves 291 and 293 providing therein a space for accommodating the sewing line.

The avoiding grooves may include at least one of a support body groove 291 provided along a longitudinal direction of the presser support body 271 (Y-axis direction and longitudinal direction of the door body) or a compression body groove 293 provided along a longitudinal direction of the compression body 281.

The support body groove 291 may be provided as a groove in which a surface of the presser support body 271 is bent to be away from the compression body 281. Further, the compression body groove 293 may be provided as a groove in which a surface of the compression body 281 is concavely bent to be away from the presser support body 271.

Unlike as shown in FIG. 10, the presser support assembly 27 may be provided on the accommodating space door 26 and the compression portion 28 may be provided in the accommodating space 25.

In order to effectively remove the wrinkles of the pants and to effectively strengthen the creases of the pants, the door body 21 may be further include a supply hole 215 communicating the accommodating space 25 and the laundry receiving space 11 with each other. Since the supply hole 215 is provided to penetrate the door body 21, water vapor and air supplied into the laundry receiving space 11 through the supply parts 3 and 4 may be supplied to the pants through the supply hole 215.

The present disclosure may be implemented in various forms. Thus, the scope of the present disclosure is not limited to the above-described embodiment. Therefore, when a modified embodiment includes components of claims of the present disclosure, the modified embodiment should be regarded as falling within the scope of the present disclosure.

What is claimed is:

1. A laundry treating apparatus comprising:

a cabinet;

a laundry receiving space defined in the cabinet and configured for receiving laundry therein;

an insertion opening defined in a front face of the cabinet and in fluid communication with the laundry receiving space;

a door rotatably fixed to the cabinet to open and close the insertion opening;

a supply unit configured to supply at least one of air or water vapor to the laundry receiving space;

a support assembly provided in the laundry receiving space and configured to support the laundry;

a door detection unit configured to detect whether the door opened the insertion opening, and a conveying part configured to move the support assembly toward the insertion opening when the door opens the insertion opening, wherein the conveying part moves the support assembly toward the insertion opening when the door detection unit detects the door is opened.

2. The laundry treating apparatus of claim 1, wherein the conveying part moves the support assembly to be away from the insertion opening when the door closes the insertion opening.

3. The laundry treating apparatus of claim 2, wherein the support assembly includes a support bar located in the laundry receiving space and spaced apart from an upper surface of the laundry receiving space, the support bar configured to support, and wherein the conveying part moves the support bar.

4. The laundry treating apparatus of claim 3, wherein the support bar extends along the width direction of the cabinet.

5. The laundry treating apparatus of claim 4, wherein a distance from the insertion opening to a center of the support bar is set to be equal to or below ⅓ of a length of the laundry receiving space parallel to a direction of movement of the support bar when the door opens the insertion opening.

6. The laundry treating apparatus of claim 4, wherein a distance from the insertion opening to a center of the support bar is set to be equal to or above ½ of a length of the laundry receiving space parallel to a direction of movement of the support bar when the door closes the insertion opening.

7. The laundry treating apparatus of claim 3, further comprising:

an upper chamber distinguished from the laundry receiving space via a partition and positioned above the laundry receiving space;

a first slit provided to penetrate the partition to communicate the laundry receiving space with the upper chamber; and a second slit provided to penetrate the partition to communicate the laundry receiving space with the upper chamber, and wherein the support assembly includes:

a base provided inside the upper chamber and capable of reciprocating between the front face of the cabinet and a rear face of the cabinet;

a first connector having one end thereof fixed to the base and the other free end thereof inserted into the first slit to be positioned in the laundry receiving space;

a second connector having one end thereof fixed to the base and the other free end thereof inserted into the second slit to be positioned in the laundry receiving space; and a support bar having one end thereof fixed to the first connector and the other end thereof fixed to the second connector to support a hanger.

8. The laundry treating apparatus of claim 7, wherein the conveying part reciprocates the base in a direction between a portion where a center of the laundry receiving space positioned and a portion where a center of the insertion opening is positioned.

9. The laundry treating apparatus of claim 8, wherein when the conveying part reciprocates the base, the support bar is reciprocated in a same direction with the base.

10. The laundry treating apparatus of claim 7, wherein the conveying part includes:

a rack provided on the base;

a pinion provided in the upper chamber and coupled to the rack; and a pinion motor configured to rotate the pinion.

11. The laundry treating apparatus of claim 8, further comprising an actuating assembly configured to reciprocate the support bar along a direction perpendicular to the direction in which the base reciprocates.

12. The laundry treating apparatus of claim 2, wherein the conveying part moves the support assembly to be away from the insertion opening when the door detection unit detects the door is closed.

13. The laundry treating apparatus of claim 2, wherein the door includes:

a door body pivotably connected to the cabinet and configured to open and close the insertion opening;

an accommodating space defined in a door front face and configured to be exposed to an outside of the cabinet when the door body closes the insertion opening;

an accommodating space door pivotably connected to the door body and configured to open and close the accommodating space;

a laundry fixing portion included in the accommodating space and configured to fix one end of an article of clothing;

a presser support body configured to support one side of the article of clothing fixed to the laundry fixing portion; and a compression body included on the accommodating space door and configured to press the article of clothing towards the presser support body when the accommodating space door closes the accommodating space.

14. The laundry treating apparatus of claim 13, further comprising a supply hole defined through the presser support body and configured to provide fluid communication between the laundry receiving space and the accommodating space.

15. The laundry treating apparatus of claim 13, wherein the laundry supported on a support assembly and the article of clothing fixed to the laundry fixing portion are placed perpendicular to each other.

* * * * *